US005371941A

United States Patent [19]

Sen Gupta

[11] Patent Number: 5,371,941

[45] Date of Patent: Dec. 13, 1994

[54] APPARATUS FOR ATTACHING A SLIDER TO A SLIDE FASTENER STRINGER

[75] Inventor: Sisir K. Sen Gupta, Gastonia, N.C.

[73] Assignee: Opti Patent-, Forschungs-und Fabrikations-AG, Riedern-Allmeind, Switzerland

[21] Appl. No.: 154,778

[22] Filed: Nov. 18, 1993

[30] Foreign Application Priority Data

Dec. 12, 1992 [DE] Germany ..... 4241954

[51] Int. Cl.[5] ..... A41H 37/06

[52] U.S. Cl. ..... 29/768; 29/408

[58] Field of Search ..... 29/768, 408, 33.2

[56] References Cited

U.S. PATENT DOCUMENTS

| | | | |
|---|---|---|---|
| 3,663,000 | 5/1972 | Perlman | 29/768 |
| 3,945,103 | 3/1976 | Fujisaki et al. | 29/768 |
| 4,495,686 | 1/1985 | Fisher | 29/409 |
| 4,598,454 | 7/1986 | Yunoki | 29/768 |

*Primary Examiner*—P. W. Echols

*Attorney, Agent, or Firm*—Herbert Dubno

[57] ABSTRACT

Sliders are mounted in a continuous string or by swinging them into gaps in the otherwise continuous coupling chain. An opening or spreading device operates coupling members of the chain adjacent the gap and downstream thereof a fixing ram holds the members in position while the manipulator inserts the slide. A top guide and a lower guide are provided to receive the slider between them and to thread the free edges of the stringer threads into the slots on opposite sides of the cylinder core.

10 Claims, 6 Drawing Sheets

FIG. 3
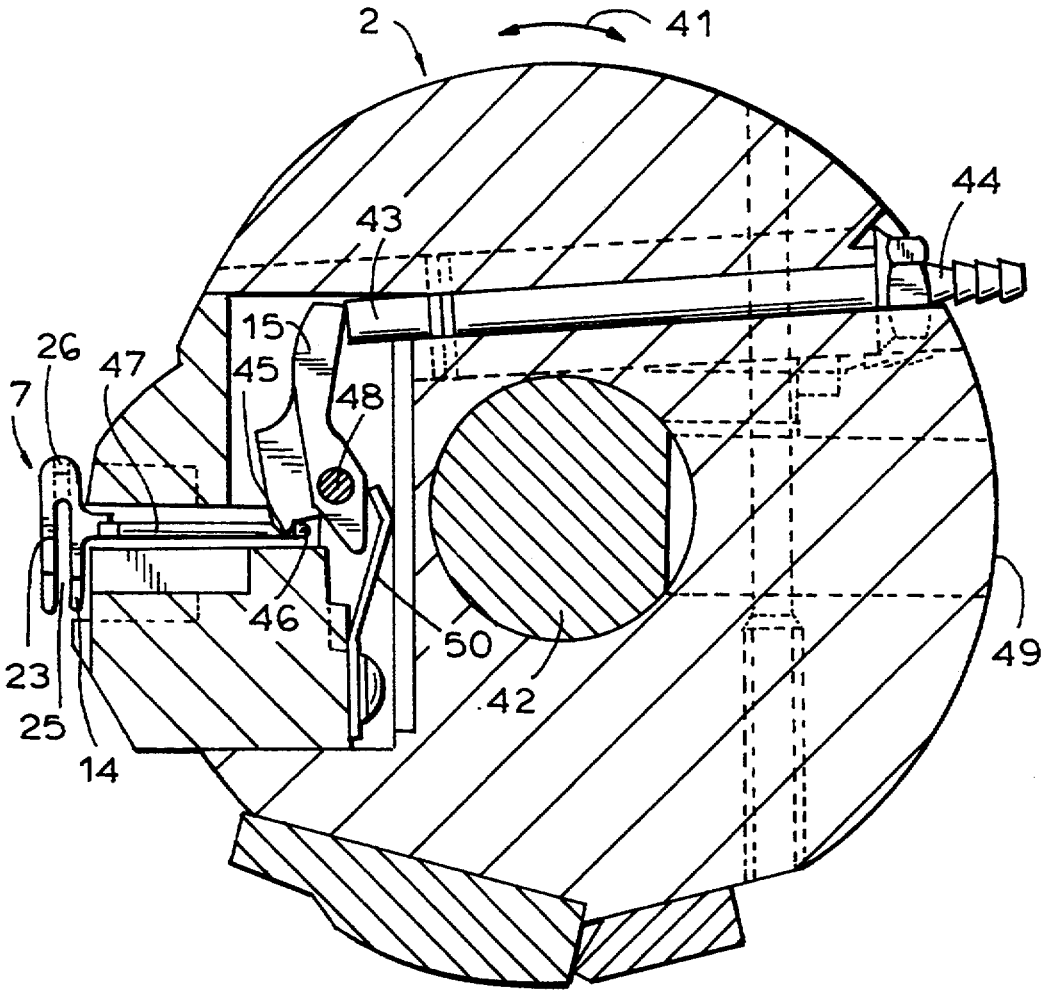
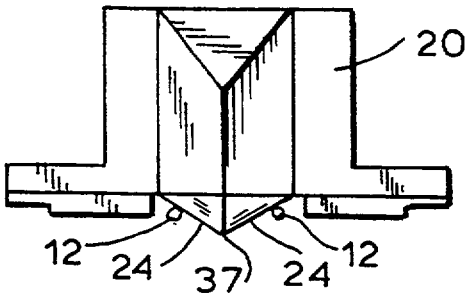
FIG. 5

FIG. 4a
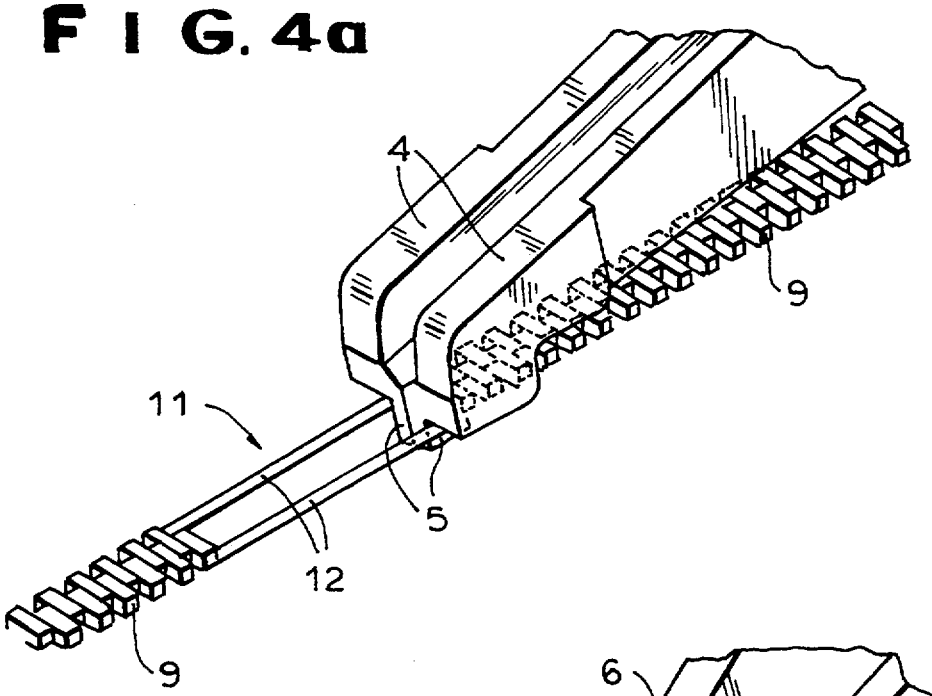
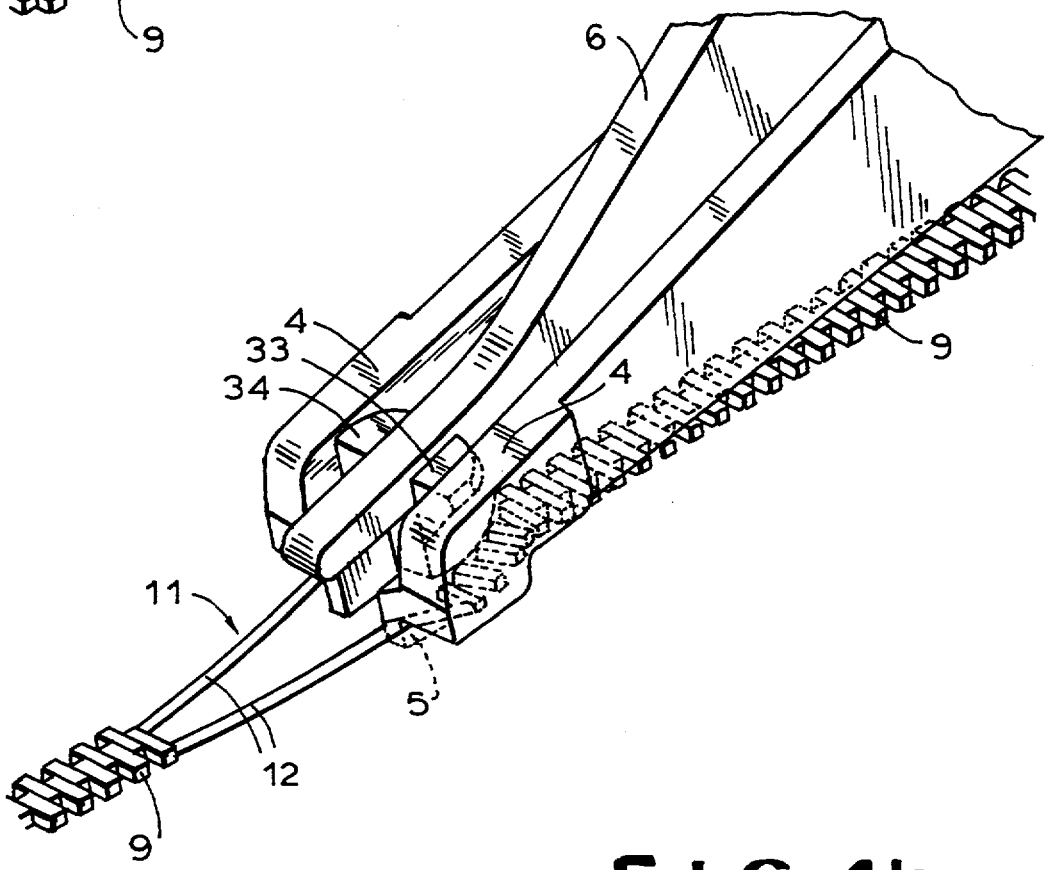
FIG. 4b

FIG. 4c
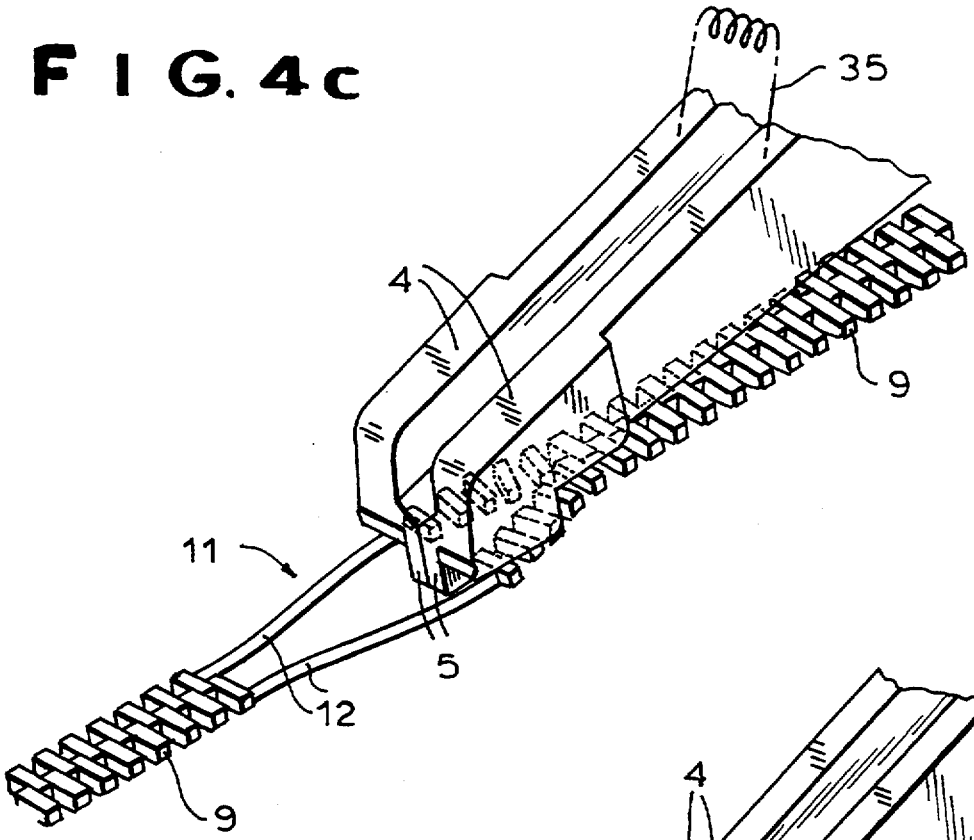
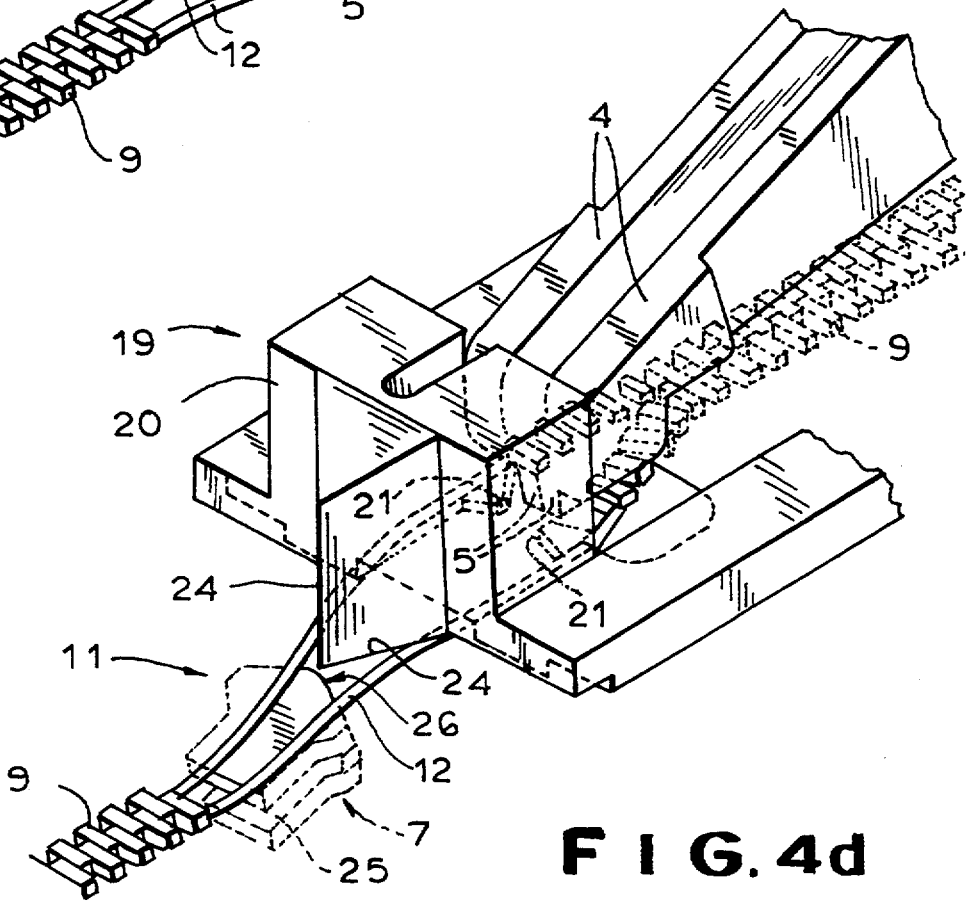
FIG. 4d

APPARATUS FOR ATTACHING A SLIDER TO A SLIDE FASTENER STRINGER

FIELD OF THE INVENTION

The present invention relates to an apparatus for attaching a slider to a long slide fastener chain having coupled-together rows of fastener members, i.e. a stringer.

BACKGROUND OF THE INVENTION

A long slide fastener chain can have a fly strip sewn to one stringer tape and chain of coupled-together rows of fastener members, the chain being subdivided by gaps into portions corresponding to subsequent slide fasteners (see U.S. Pat. No. 1,495,686).

On a first side of the chain an opening or spreading device is provided for opening up the chain and uncoupling the fastener member rows near the opening or spreading device. The device can have two opening lever arms which are movable oppositely to one another, are spring-biased towards one another and have abutments and an opener or spreader adapted to drop in between the opening lever arms.

On the second side of the chain a slider manipulator is provided to receive a slider and to pivot the same into the gap. A delivery device is disposed downstream of the opening or spreading device and the slider manipulator in the direction of movement of the stringer and has two driven rollers. The driven rollers are associated with the stringers and are connectable non-positively thereto. The slider is attachable by way of its core end to the uncoupled closure members by a movement of the slider in the opposite direction to the movement of the chain.

A slider has a bottom part and a top part interconnected by way of a core disposed at one end of the slider. The two fastener member rows project uncoupled from such end in the case of an attached slider. At the opposite end of the slider, also known as the slider mouth, the closure member rows extend coupled together from the slider. Also, the slider is formed on both sides with stringer-guiding slots enabling the stringers to extend through the slider. Each of the two rows of fastener members of the slide fastener chain has a stringer.

In one particular form of a slide fastener chain a fly strip, as noted, for example of cloth, is sewn to a stringer. The fly strip is comparatively wide, usually projects on one side beyond the stringer to which it is sewn and overlaps the closure member rows on the other side. A fly strip facilitates the attachment of a finished slide fastener to a garment.

A device for folding the fly strip which can expose the closure member rows covered thereby must therefore of course be disposed upstream of an apparatus for attaching a slider to a long slide fastener chain having a fly strip.

The word "gap" denotes a region of a long slide fastener chain where a predetermined number of closure members are missing from both stringers, so that inside free stringer edges, possibly in the form of edge beads or edge bead threads, are exposed.

In an opening or spreading device having two spreading lever arms and a spreader or opener the spreading levers and/or the opener have actuating surfaces lever arms, press the same apart from one another. The spreading lever arm abutments which have dropped into a gap spread or open the stringers on the inside free stringer edges of the gap and uncouple a few closure members near the opening or spreading device.

A slider manipulator can be, for example, of substantially drum-shaped construction, in which event it has a rotational axis extending transversely to the length of the slide fastener chain. During a rotation of the manipulator a slider can be received, for example, from a rail of a slider feeder.

As a rule, the top part of the slider points towards the rotational axis and the slider can be retained and released by means of a controllable finger. During further rotation of the manipulator the slider is pivoted into the opened gap, drawn on to the uncoupled closure members and released from the manipulator. Basically, further means can be provided near the manipulator to attach a leader to the chain after attachment of the slider, to sever the tapes in the gap and/or to attach end members. A finished slide fastener can therefore be produced from a long slide fastener chain in a single movement cycle.

The apparatus of U.S. Pat. No. 4,495,686 has an opener or spreader which remains in its dropped position after it has dropped in between the spreading lever arms, so that the stringers continue to remain wide open during the attachment of the slider. The spacing between the inside free stringer edges is only slightly less than the width of the slider to be attached. When the slider pivots into the gap the inside free stringer edges are threaded in automatically by the stringers which are subjected to tension near the gap by means of the delivery device. This is the most critical step in the attachment of the slider.

A disadvantage of the known apparatus is that during this step the inside free stringer edges are opened very wide, there is no active guidance of the slider during the threading of the inside free stringer edges into the stringer-guiding slots and the inside free stringer edges cannot themselves be maintained in tension. Malfunctioning in the threading of the inside free stringer edges into the stringer-guiding slots in the slider may therefore occur which may be very disturbing and cause an interruption in continuous production. Another disadvantage is the continuous wide opening which occurs even in a satisfactory threading-in operation of the inside free stringer edges since the uncoupled closure member rows tend to twist and therefore to jam during the remainder of the slider attachment step.

Objects of the Invention

It is therefore an object of the present invention to provide a slider attachment apparatus which is very reliable in operation.

Another object of the invention is to provide an improved slider mounting apparatus which is free from the abovementioned disadvantages.

Summary of the Invention

According to the invention, slider guide means are adapted to guide the slider while it is being fed into the gap by means of a top guide and a bottom guide, the top guide having edges for threading the two inside free stringer edges of the gap into stringer-guiding slots in the slider, the inside free stringer edges being adapted to be threaded in when the opener or spreader is in its raised position. The delivery device also has a fixing ram for fixing the fastener member rows.

Thanks to this combination, the inside free stringer edges can be threaded very reliably and controllably into the stringer-guiding slots, first because the inside stringer edges themselves can be tensioned by means of the fixing ram acting on the closure member rows and second because the threading-in movement of the tensioned inside free stringer edges can be controlled actively by way of the threading-in edges. Also, the fact that the inside free stringer edges can be threaded in with the opener or spreader raised ensures that because of the tension the stringer edges can be introduced a considerable distance into the stringer-guiding slots in the slider. Since the opening or spreading width is therefore relatively small during the step of attaching the slider, there is considerably less risk of the uncoupled closure members accidentally twisting.

U.S. Pat. No. 4,598,454 discloses a different kind of apparatus for threading the two inside free stringer edges into the stringer-guiding slots of the slider by means of a rod which is disposed transversely to the length of the slide fastener chain. The rod, is disposed after the opening or spreading device and the slider manipulator and during the pivoting-in of the slider exerts pressure on that side of the chain which is near the opening or spreading device. Basically this feature increases the tension of the inside free stringer edges. However, no active guidance by means of threading-in edges is provided to thread the stringer edges into the slider nor is a fixing ram provided to fix the closure member rows. Also, the slider is pivoted in and attached with the opener or spreader dropped, and so this known apparatus suffers from the disadvantages hereinbefore mentioned.

To provide further security against accidental twisting of the uncoupled closure members, the spreading lever arms have abutment surfaces for the uncoupled closure members, the latter surfaces extending parallel to the plane of the slide fastener chain. While the slider is being pivoted in the inside stringer edges are pressed towards the abutment surfaces and the uncoupled closure members engage with the abutment surfaces over a large area.

In a very advantageous embodiment of the invention the top slider guide has a guide surface on which the underside of a bottom part of a slider can be guided over a considerable surface area when the slider is being pivoted into the gap. Advantageously, the guide surface of the top guide has a dividing surface which is preferably in the form of an isosceles triangle, the threading edges being embodied by the two equal sides of the triangle, the apex which is formed by the two threaded edges pointing towards the delivery device.

To further facilitate threading-in of the inside free stringer edges, the threading edges are disposed at an acute angle to one another. The result is that when the slider pivots into the gap a movement pattern occurs in which during the pivoting-in of the slider the core end thereof first contacts the apex formed by the two threading-in edges, whereafter during further pivoting-in of the slider the inside free stringer edges are pushed by the threading-in edges around the edges of the bottom part of the slider near the core thereof and threaded into the stringer-guiding slots in the slider.

Advantageously, the delivery device has unpowered corotating pressing rollers on that side of the stringers which is remote from the delivery rollers. In this event, the delivery rollers can be spring-biased and movable towards the pressing rollers.

A particular feature of the spring biasing is that it ensures reliable delivery even though the thickness of the material may vary near the stringers, for example, because of a sewn-on fly strip.

In another advantageous embodiment of the invention, the delivery device has a pressing ram on that side of the closure member rows which is remote from the fixing ram. In this event the fixing ram can be movable towards the pressing ram. A very simple but effective form of alternate operation of the delivery device between its "delivery" and "fixing" functions can be provided if the delivery rollers and the fixing ram are interconnected for movement perpendicularly to the plane of the slide fastener chain.

More particularly, an apparatus for mounting sliders in gaps between rows of coupling members interdigitated in a coupling chain interrupted at the gaps of the continuous slide fastener stringers can comprise:

an opening and spreading device in one side of the stringer including means engageable in the gaps for opening up the chain and uncoupling coupling members adjacent the gaps, the opening and spreading device including:

a pair of lever arms engageable in the gaps upon the positioning of a respective gap at the opening and spreading device, spring means biasing the arms toward one another, abutments formed on the arms and engageable between coupling members of the respective rows, and a spreader positioned to fit between the arms and to spread the arms apart;

a slider manipulator on an opposite side of the stringer provided with means for receiving a slider and displaceable to swing the slider into a respective gap positioned at the opening and spreading device;

a delivery device downstream of the opening and spreading device and the manipulator in a direction of displacement of the stringer, the delivery device including:

two driven rollers engageable with respective halves of the stringer for exerting tension thereon, and a fixing ram engageable with the rows for fixing same in position while a slider is mounted on the stringer; and slider guide means for guiding the slider onto the stringer in the gap positioned at the opening and spreading device, the slider guide means including:

a top guide formed with edges threading two inner free stringer edges free from the members into stringer guiding slots of the slider when the spreader is in a raised position, and a bottom guide juxtaposed with the top guide and together with the top guide positively positioning the slider between the guides.

BRIEF DESCRIPTION OF THE DRAWINGS

The above and other objects, features and advantages of the invention will become more readily apparent from the following description, reference being made to the accompanying highly diagrammatic drawing in which:

FIG. 3 is a cross section through the slider manipulator near a retained slider;

FIGS. 4*a* to 4*e* show the movement pattern of the step of attaching a slider; and FIG. 5 is an end view of the upper guide member showing the engagement of the wedge shaped formation thereof with the free edges of the stringer freely from coupling members for guiding these free edges into the edge receiving slots of the slider.

SPECIFIC DESCRIPTION

Figure 1:
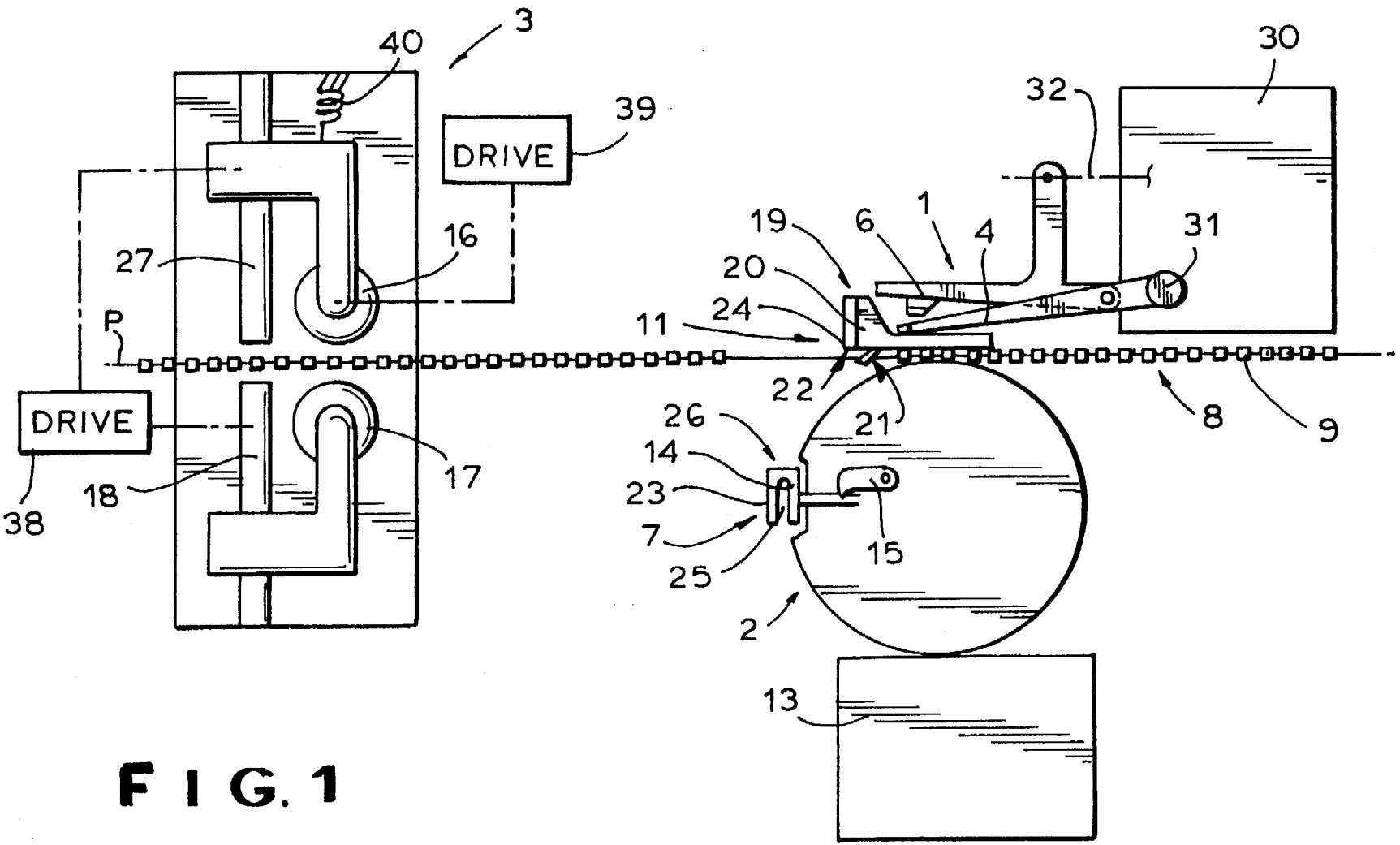
FIG. 1 is a side elevational view diagrammatically showing the construction of an apparatus according to the invention.
Figure 2:
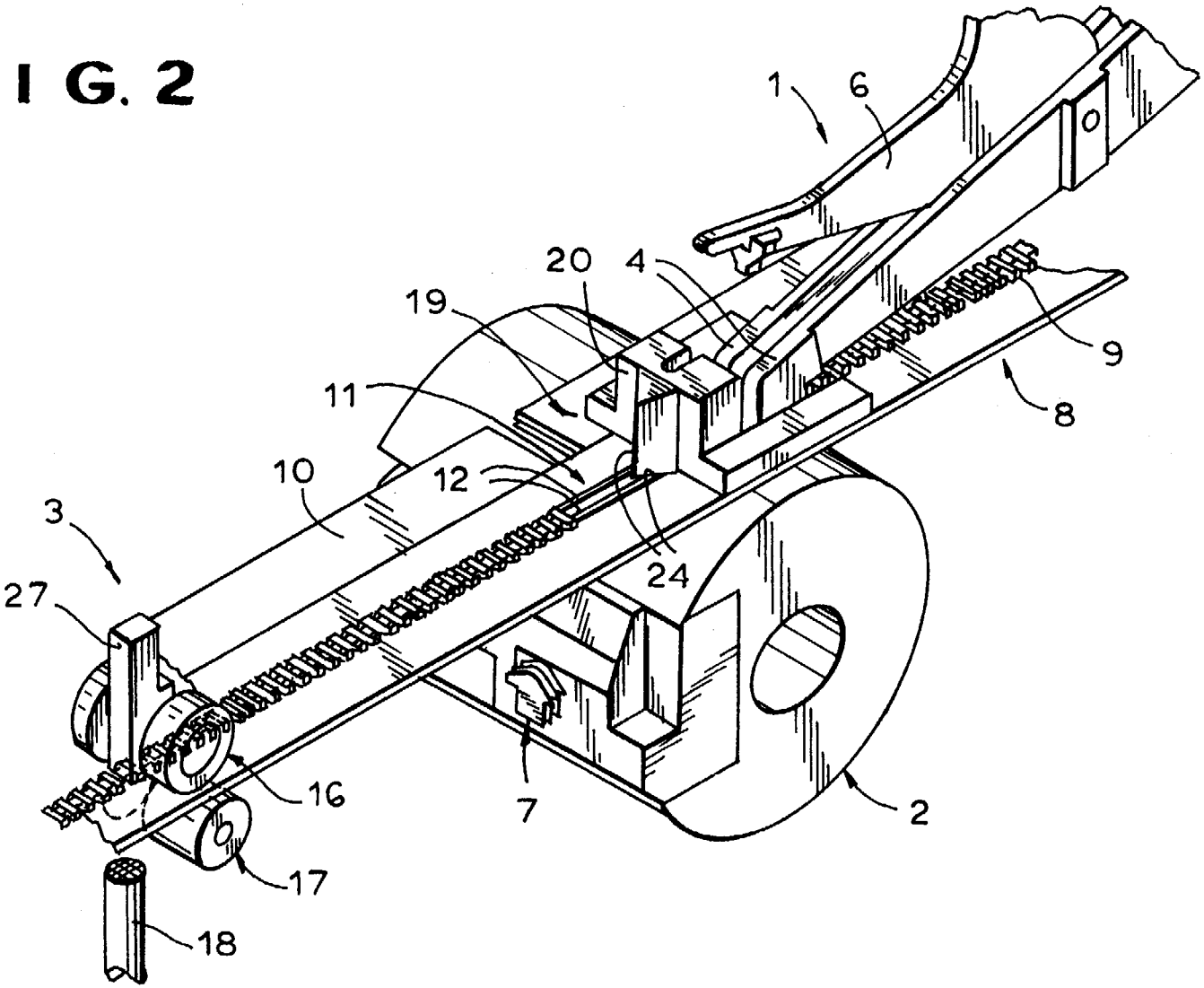
FIG. 2 is a perspective view of the subject of FIG. 1.

Referring to FIGS. 1 and 2, an apparatus according to the invention for attaching a slider 7 to a long slide fastener chain 8 having coupled-together closure member rows 9 basically comprises a spreading or opening device 1 disposed on a first side of such chain, a basically drum-shaped slider manipulator 2 disposed on the second side of the chain and a delivery device 3 disposed downstream of the opening or spreading device 1 and the manipulator 2.

The device 1 has two spreading lever arms 4 movable in opposite directions to one another and spring-biased towards one another and having abutments 5; and an opener or spreader 6 adapted to drop in between the arms 4. The abutments 5 are concealed in FIGS. 1 and 2 but their arrangement will be apparent from FIGS. 4*a* to 4*e*.

As can be gathered more particularly from FIG. 2, the slider 7 is adapted to be threaded onto a long slide fastener chain 8 having a fly strip 10 sewn to a stringer.

A device for folding the fly strip 10 which is disposed upstream of the spreading or opening device 1 as considered in the direction of movement of the chain 8 is not shown; however, as can be gathered from FIGS. 1 and 2 the strip 10 has left the cows 9 exposed. A gap 11 where closure members of both stringers are missing is clearly apparent. In the embodiment illustrated the inside stringer edges take the form of edge bead threads 12.

The rotational axis of the manipulator 2 extends transversely to the length of the chain 8. During a rotation of the manipulator 2 a slider 7 can be received from a slider feeder 13; the slider top part 14 points towards the rotational axis and the slider 7 can be retained and released by means of a controllable finger 15, a feature which is very clearly apparent in FIG. 3. For the sake of clarity other facilities for attaching a leader to the chain 8 and for severing the stringers in the gap 11, which are usually associated with the manipulator 2, are not shown.

The delivery device 3 basically comprises delivery rollers 16, unpowered corotating pressing rollers 17 on the opposite side of the stringers, a fixing ram 18 and, on that side of the rows 9 which is remote from the ram 18, a pressing ram 27. The rollers 16 are spring-biased and movable towards the pressing rollers 17. The rollers 16 and ram 18 are interconnected for this movement perpendicular to the plane of the chain 8. Consequently, the rollers 16 separate from the stringers when the ram 18 rises and the rows 9 are fixed. Basically, the delivery device 3 can move relatively to the opening or spreading device 1 and the manipulator 2 lengthwise of the chain 8.

Disposed immediately downstream of the device 1 is a slider feeder 19 having a top slider guide 20 and a bottom slider guide 21. The bottom guide 21 can be seen particularly clearly in FIG. 4*e*. The top guide 20 has a guide surface 22 on which the underside 23 of a bottom part of a slider can be guided by way of a large area. The guide surface 22 has a dividing surface in the form of an isosceles triangle whose two equal-length sides serve as threading-in edges 24 for the inside free stringer edges or threads 12 and are adapted to thread the same into stringer guiding slots 25 in a slider 7. The two edges 24 are disposed at an acute angle to one another and the apex they form points towards the delivery device 3.

FIGS. 4*a* to 4*e* illustrate the basic movement pattern associated with the attachment of a slider 7. For the sake of clarity only the rows 9 and the threads 12 of the stringers are shown; the delivery device 3 and the manipulator 2 are not shown.

In FIG. 4*a* the arms 4 of the device 1 are shown after the abutments 5 have dropped into a gap 11 and have engaged closure members adjacent the same. The striking by the abutments of the closure members triggers the dropping-in of the spreader or opener 6, the chain 8 being opened or spread and a few closure members of the rows 9 being uncoupled near the spreading or opening device 1 (FIG. 4*b*).

Immediately afterwards the opener 6 rises so that the arms 4 are spring-biased back towards one another, the distance between the threads 12 near the gap 11 decreasing (FIG. 4*c*).

As FIG. 4*d* shows, when a slider 7 is pivoted into the gap 11 by the manipulator 2 the core end 26 of the slider bottom part contacts an apex of the slider guide means 19, the latter apex being formed by threading-in edges 24. As the slider 7 pivots in further, the threads 12 are pushed around the edges of the slider bottom part by the edges 24 and threaded into the stringer-guiding slots 25 in the slider 7.

Figure 4E:
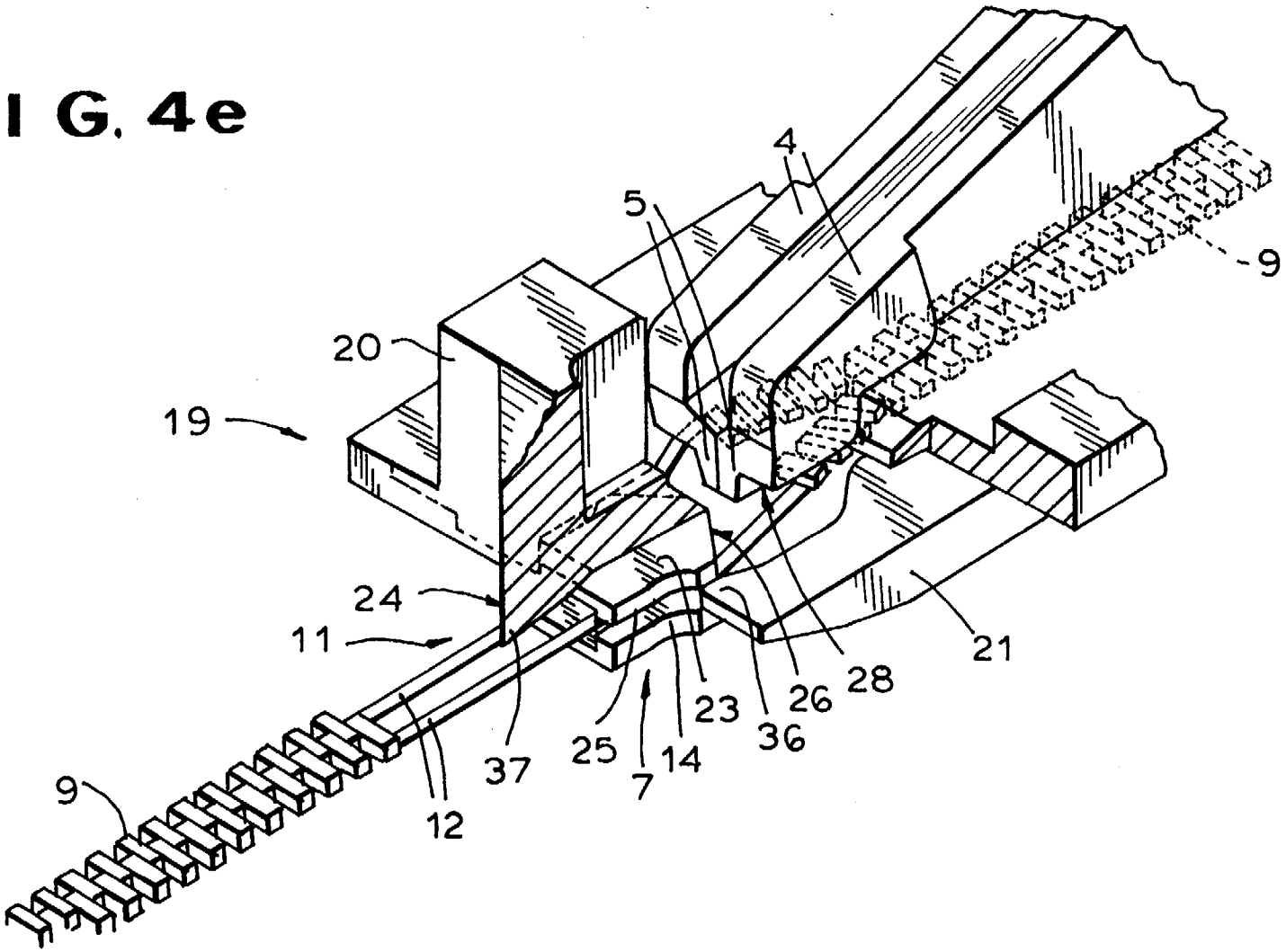

FIG. 4*e* shows the condition after the slider 7 has been fully pivoted in and the threading-in of the threads 12 has been completed. FIG. 4*e* also gives a sectioned view of the slider guide means 19 in order to clarify matters further. As will be more particularly apparent, the underside 23 of the slider bottom part is guided over a large area of the device 19. Also clearly apparent in the sectional view of FIG. 4*e* is the bottom slider guide 21 of the means 19, the guide 21 engaging in the slot 25 in the slider 7. As FIG. 4*e* also shows, the arms 4 have abutment surfaces 28 for the uncoupled closure members, the surfaces 28 extending parallel to the plane of the chain 8. Further attachment of the slider 7 to the chain 8 proceeds conventionally, the core end 26 of the slider 7 being drawn on to the uncoupled closure members by a movement of the slider 7 in the opposite direction to the movement of the chain 8.

As can be seen from FIG. 1, a mechanism 30 is connected at 31 to the levers 4 for raising and lowering them and at 32 to the spreader 6 for raising and lowering it. The spreader 6 has lateral camming formations 33 and 34 which wedge the arms 4 apart at their free ends, the arms being spring-biased toward one another as represented by the spring shown at 35 in FIG. 4*c*.

The lower member 21 can be formed, as can be seen in FIG. 4*e*, with projections 36 engageable in the laterally opening slots 25 of the slider for position same. The lower side of the top guide 20 can dip down at 37 (FIG. 5) to engage between the edges 12 which are free from the coupling members so that the edges 24 can separate and guide them as has been described.

As is also apparent from FIG. 1, the driven rollers 16 and the fixing ram 18 can be coupled together for joint movement, e.g. by the drive 38 for countermovement in opposite directions perpendicular to the plane P of the stringer so that when the stringer is engaged by the fixing ram 18, the driven rollers 16 are disengaged and vice versa.

The drive for the rollers 16 is represented at 39 and the movement of the rollers 16 against the stringer can be spring-biased as represented by the spring 40.

As can be seen from FIG. 3, the manipulator 2 which can swing the slider 7 into the gap, can be oscillated in the direction of arrow 41 on a shaft 42 and can be formed by a pneumatically actuated plunger 43 connected at 44 to a compressed air force and valve, serving to trip the latch 15 whose tooth 45 engages in an eye 46 of the handle or flap 47 of the slider 7.

The latch 15 is pivotally mounted at 48 to the body 49 of the manipulator and is urged in its open position by a leaf spring 50. The pneumatic force applied to the plunger 43, therefore, retains the slider on the manipulator until the pneumatic pressure is released.

I claim:

1. An apparatus for mounting sliders in gaps between rows of coupling members interdigitated in a coupling chain interrupted at said gaps of a continuous slide-fastener stringer, said apparatus comprising:

an opening and spreading device in one side of said stringer including means engageable in said gaps for opening up said chain and uncoupling coupling members adjacent said gaps, said opening and spreading device including:

a pair of lever arms engageable in said gaps upon the positioning of a respective gap at the opening and spreading device, spring means biasing said arms toward one another, abutments formed on said arms and engageable between coupling members of the respective rows, and a spreader positioned to fit between said arms and to spread said arms apart;

a slider manipulator on an opposite side of said stringer provided with means for receiving a slider and displaceable to swing said slider into a respective gap positioned at said opening and spreading device;

a delivery device downstream of said opening and spreading device and said manipulator in a direction of displacement of said stringer, said delivery device including:

two driven rollers engageable with respective halves of said stringer for exerting tension thereon, and a fixing ram engageable with said rows for fixing same in position while a slider is mounted on the stringer; and slider guide means for guiding said slider onto the stringer in said gap positioned at said opening and spreading device, said slider guide means including:

a top guide formed with edges threading two inner free stringer edges free from said members into stringer-guiding slots of said slider when said spreader is in a raised position, and a bottom guide juxtaposed with said top guide and together with said top guide positively positioning said slider between said guides.

2. The apparatus defined in claim 1 wherein said lever arms have surfaces extending parallel to a plane of said chain for engagement with the uncoupled members, thereby positively locating said uncoupled members with respect to said slide.

3. The apparatus defined in claim 1 wherein said top guide has a guide surface on which an underside of said slider is guided over a substantial surface area as said slider is swung into a gap positioned at said opening and spreading device.

4. The apparatus defined in claim 1 wherein said guide surface has a dividing surface in the form of an isosceles triangle, said triangle edges being formed by the two equal sides of said triangle, said threading edges forming an apex pointing toward said delivery device.

5. The apparatus defined in claim 1 wherein said threaded edges are disposed at an acute angle to one another.

6. The apparatus defined in claim 1 wherein said delivery device has one driven pressing roller on a side of the stringer opposite that upon which said driven rollers are provided.

7. The apparatus defined in claim 6 further comprising means for spring biasing said driven rollers toward said pressing rollers.

8. The apparatus defined in claim 1 wherein said delivery device comprises a pressing ram on a side of said rows opposite said fixing ram.

9. The apparatus defined in claim 8 wherein said fixing ram is movable toward said pressing ram.

10. The apparatus defined in claim 1 wherein said rollers and said ram are interconnected for movement perpendicular to a plane of said stringer.

* * * * *